United States Patent [19]

Fletcher

[11] 4,022,181

[45] May 10, 1977

[54] BOWSTRING DRAW AND TRIGGER RELEASE APPARATUS

[76] Inventor: James D. Fletcher, P.O. Box 218, Bodfish, Calif. 93205

[22] Filed: Sept. 2, 1975

[21] Appl. No.: 609,293

[52] U.S. Cl. ..... 124/35 A

[51] Int. Cl.[2] ..... F41C 19/00

[58] Field of Search ..... 124/35 A, 31, 35 R, 124/24 R, 23 R, 41 R, 41 A

[56] References Cited

UNITED STATES PATENTS

| | | | |
|---|---|---|---|
| 3,028,851 | 4/1962 | Drake | 124/35 R X |
| 3,916,868 | 11/1975 | Wolfe | 124/35 A |
| 3,929,120 | 12/1975 | Barner | 124/35 A |

*Primary Examiner*—Richard C. Pinkham

*Assistant Examiner*—William R. Browne

[57] ABSTRACT

A bowstring draw and trigger release for use with conventional archery bows and the arrows used therewith. The bowstring draw and trigger release is used for drawing a bowstring taut and releasing same to project the arrow upon the triggering of the apparatus. The bowstring draw and trigger release utilizes a looped draw cord which is disposed about the bowstring and secured by a pivotally mounted holding member. The holding member pivots about a fixed shaft, an end thereof being coupled to the trigger of the apparatus. Actuation of the trigger causes the rotation of a directly coupled member which engages the holding member causing same to rotate forwardly allowing the loop to slide therefrom and thereby release the bowstring.

7 Claims, 6 Drawing Figures

BOWSTRING DRAW AND TRIGGER RELEASE APPARATUS

BACKGROUND OF THE INVENTION

1. Field of the Invention

The present invention generally relates to archery devices and, more particularly, to those devices used to draw and release a bowstring.

2. Prior Art

The prior art discloses a number of bowstring pull and trigger release mechanisms which are utilized to assist archers in pulling and holding the bowstring of a conventional bow in tensioned or taut relationship with the triggering mechanism being used to release the bowstring and thereby project the arrow in a forward direction. One of the problems which is inherent in the release of a bowstring arises from the characteristics of the bowstring when it is suddenly released and allowed to return to its normal untensioned position in the bow. Once the bowstring is released, the bowstring will produce side pressure with twisting being a consequent result thèreof. Arrows which are projected from a twisting bowstring do not travel in the direction intended due to the deflection caused by the side pressure and twisting thereby resulting in pour accuracy in the aim and trajectory of the arrow.

A specific device disclosed by the prior art utilizes a self-contained bowstring draw and trigger release. The device disclosed by the prior art employs a holding member which is used to temporarily secure a loop which holds the bowstring in a taut position. A trigger which pivots about a fixed shaft is totally independent of the holding member and contacts the holding member in a manner which has conventionally been designated as a sear. The trigger is urged against a resilient spring, a projection of the trigger preventing the holding member from rotating under the force of the tensioned bowstring. When the trigger is pivoted, the projection thereof releases the holding member thereby permitting the bowstring to return to its untensioned position and thereby launching the arrow. One of the problems inherent in this type of device is the high forces imposed on the trigger projection and holding member, i.e., the sear elements. The contacting surfaces are continually worn under the effect of the bowstring tension thereby deforming the profile of the contacting members, the eventual result thereof being the inoperability of the device. Another deleterious effect resulting from the use of a sear mechanism arises from the increase in pressure as the trigger is moved to its released position. As the area of the contacting interface of the sear contracts during the movement of the trigger, the ability to smoothly and properly release the bowstring is reduced.

The problems associated with the devices disclosed by the prior art are substantially resolved by the present invention. The present invention eliminates the sliding engagement of a sear and substitutes in place thereof a series of coupled, rotatable members which will provide for the smooth release of the bowstring and thereby substantially eliminates unnecessary wear on the component parts thereof.

SUMMARY OF THE INVENTION

The present invention comprises a mechanism used for drawing and releasing a bowstring to provide for accurate projection of an arrow. The present invention bowstring draw and trigger release apparatus is adapted to fit within the hand of an archer and provides for appropriate orientation thereof to allow the archer to release the bowstring by activating a triggering mechanism. A fixed loop is disposed about the bowstring and secured to a holding member in a manner which will permit the bowstring to be drawn to a cocked position. The trigger of the present invention is pivotally mounted in the same plane as the holding member, the rotation of the trigger being fixed in one direction and resiliently urged in the other. The trigger is coupled to the holding member in a manner which permits the bowstring to be release in a smooth manner.

The trigger of the present invention is mechanically coupled to the holding member in a manner which will only permit the bowstring to be released through the intentional depression of the trigger. The mechanical coupling intermediate the trigger and the bowstring holding member directs the force imposed by the bowstring in a direction which reinforces the holding position of the trigger. Once the trigger is depressed, the force of the bowstring is used to properly sequence the rotation of the release elements to provide for a smooth release and disengagement of the bowstring.

It is therefore an object of the present invention to provide an improved bowstring draw and trigger release apparatus.

It is another object of the present invention to provide a draw and trigger release apparatus which uses a directly coupled trigger and release mechanism.

It is yet another object of the present invention to provide a bowstring draw and trigger release apparatus which provides for selective release of the bowstring.

It is still yet another object of the present invention to provide a bowstring draw and release apparatus which is simple and inexpensive to fabricate.

The novel features which are believed to be characteristic of the invention, both as to its organization and method of operation, together with further objectives and advantages thereof will be better understood from the following description considered in connection with the accompanying drawing in which a presently preferred embodiment of the invention is illustrated by way of example. It is to be expressly understood, however, that the drawing is for the purpose of illustration and description only and is not intended as a definition of the limits of the invention.

DESCRIPTION OF THE PRESENTLY PREFERRED EMBODIMENT

Figures 1, 2, 3, 4, 5, 6:
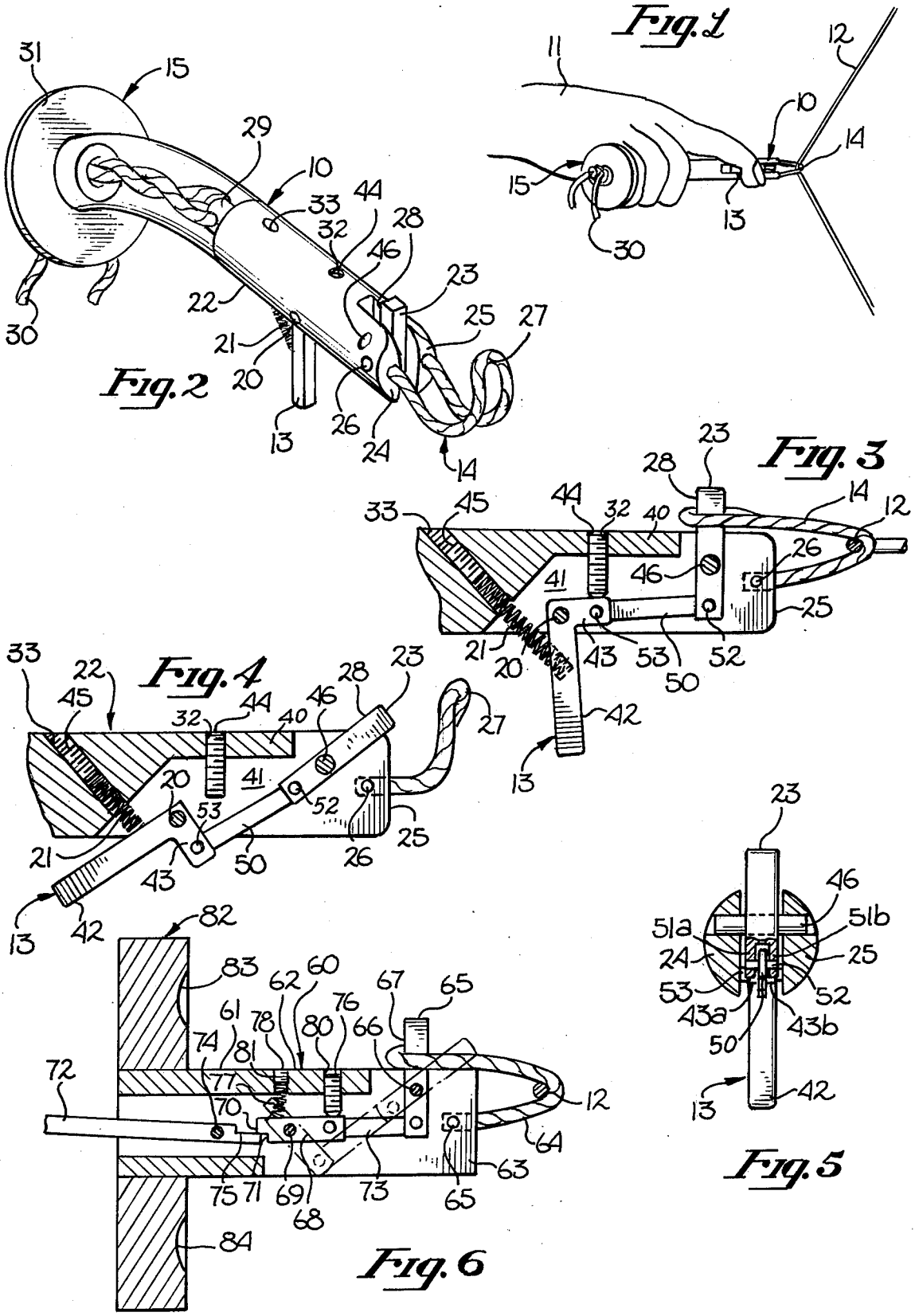
FIG. 1 illustrates a perspective view of an archer's hand on the trigger release of a bowstring draw and trigger apparatus in accordance with the present invention.
FIG. 2 illustrates a front perspective view of the present invention bowstring draw and trigger apparatus.
FIG. 3 illustrates a side elevation, partial crosssectional view of the present invention bowstring draw and trigger release apparatus with the bowstring in the drawn and held position taken through line 3—3 of FIG. 2.
FIG. 4 illustrates a side elevation, partial crosssectional view of the present invention bowstring draw and trigger release apparatus following the release of the bowstring taken through line 4—4 of FIG. 2.
FIG. 5 illustrates a cross-sectional, front elevation view of the present invention taken through line 5—5 of FIG. 2.
FIG. 6 illustrates a side elevation, partial crosssectional view of another form of the present invention bowstring draw and trigger release apparatus showing in full line the holding or cocked relationship to the bowstring and in dashed lines the released position.

The present invention can be best understood by reference to FIG. 1 wherein a preferred form of the present invention is shown being held in the right hand of an archer, the form of the present invention bowstring trigger and draw apparatus being generally designated by the reference numeral 10. The present invention apparatus 10 is being held in hand 11, the pictorial illustration shown in FIG. 1 showing bowstring 12 in the cocked position. The index finger of the archer's hand 11 rests on the trigger assembly 13. In a form of the present invention, bowstring draw cord 14 passes about bowstring 12 and is slidably coupled to a holding member which will be described in detail hereinbelow. Handle 15 is molded to comfortably fit in hand 11 irrespective of whether the archer is right handed or left handed.

Referring now to FIG. 2, a perspective view of the bowstring draw and trigger release apparatus 10 is shown. Trigger assembly 13 is journeled about shaft 20 by suitable bearings and is rotatable about shaft 20 limited only by restraints which will be discussed hereinbelow. Resilient spring 21 is interposed between body portion 22 and spring 13 to provide for a resilient force to urge trigger assembly 13 to return to its initial state after it has been depressed. Each end of bowstring draw cord 14 is inserted into apertures of flanges 24 and 25 of body portion 22 and secured therein by conventional set screws 26 or other suitable securing means. Draw cord 14 typically comprises a strong and flexible cord of approximately 3/32 inches in diameter and is made of nylon, waxed cotton or other suitable material.

Holding member 23 is disposed intermediate flanges 24 and 25 of body portion 22 and is coupled to trigger assembly 13 in a manner which will be described in detail hereinbelow. As shown in FIG. 1, bowstring 12 is drawn into its cocked position by having bowstring draw cord 14 disposed thereabout, the terminating loop 27 of draw cord 14 being placed about holding member 23 and resting against face 28 thereof. In a typical form of the present invention, body portion 22 is cylindrical and includes an axially disposed projecting eye bolt 29 which includes means for receiving cord 30 therethrough. Hand supporting or abutting shield 31 terminates the body portion 22, shield 31 being secured to body portion 22 by suitable cord 30. The section of body portion 22 adjacent shield 31 is preferably fabricated of clear plastic, although any suitable material can be used. Cord 30 is fixedly attached to body portion 22 by projecting eye bolt 29, cord 30 being twisted within the interior of body 22 and fixedly tied in a manner shown in FIG. 1.

The operation of the present invention bowstring draw and trigger release apparatus 10 can be best seen by reference to FIG. 3 and FIG. 4 which illustrate side elevation, cross-sectional views prior to and after releasing of bowstring 12. During the cocking of bowstring 12, bowstring draw cord 14 is disposed about bowstring 12, terminating loop 27 resting against face 28 of holding member 23. Face 28 is disposed at any suitable angle with respect to the force imposed by draw cord 14, the angle thereof insuring that the draw cord 14 will not inadvertently slip from holding member 23 and thereby cause premature release of an arrow. It is also to be noted that a form of the present invention can dispense with bowstring draw cord 14 and provide for direct abuttment of bowstring 12 upon face 28 of holding member 23.

Body portion 22 is substantially cylindrical in shape and terminates at flanges 24 and 25 as shown in FIG. 2. Center spine 40 lies intermediate flanges 24 and 25 and extends rearwardly away from flanges 24 and 25. Spine 40 of the body portion 22 extends downwardly to the bottom of body portion 22 defining cavity 41 within which trigger assembly 13 and holding member 23 are disposed. Trigger assembly 13 is journeled about shaft 20 on suitable bearings. Trigger assembly 13 comprises trigger handle 42 and perpendicular extension 43, shaft 20 being disposed through an aperture in trigger assembly 13 at the intersection of trigger handle 42 and extension 43. An aperture 32 is disposed through spine 40 substantially in the vicinity of the terminus of extension 43. Set screw 44 is threaded into aperture 32 and adjustably restrains the counterclockwise rotation of trigger 13 about shaft 20. Set screw 44 provides for the suitable position of holding member 23 to insure that the force imposed by a cocked bowstring 12 will not cause inadvertent release of an arrow. A second aperture 33 is disposed obliquely into spine 40. Spring 21 is disposed into aperture 33 and urged against trigger handle 42. To secure the opposite end of spring 21, set screw 45 is threaded into aperture 33 and is placed in abuttment with spring 21. A combination of set screw 44 and resilient spring 21 thereby restrain the clockwise the counterclockwise rotation of trigger 13.

Holding member 23 is journeled about shaft 46 by suitable bearings and is rotatably held intermediate flanges 25 and 26 as shown in FIG. 2. As can be seen in FIG. 3, clockwise rotation of holding member 23 will permit release of bowstring draw cord 14. Coupling member 50 is journeled intermediate trigger extension 43 of trigger assembly 13 and lower terminus 51 of holding member 23. As can be seen in FIG. 5, a symmetrically disposed cavity is formed in the lower terminus of holding member 23 thereby forming flanges **51*a* and 51*b*. Coupling 50 is disposed between flanges 51*a* and 51*b* of holding member 23 and journeled about shaft 52. In a like manner, a symmetrical cavity is disposed into trigger extension 43 thereby forming a pair of flanges 43*a* and 43*b*. Coupling 50 is disposed intermediate flanges 43*a* and 43*b* and journeled about a shaft 53 which is connected intermediate 43*a* and 43*b* of trigger 13**.

As set forth hereinabove, FIG. 3 illustrates the present invention 10 after bowstring 12 has been withdrawn into the cocked position. Several of the objectives of the present invention are to provide a smooth release of bowstring 12 and to prevent inadvertent release of an arrow as a result of the forces imposed by a taut bowstring 12. The assembly formed by trigger assembly 13, coupling 50 and holding member 23 achieve the stated objectives. Resilient spring 21 is in a normal state of compression and therefore urges trigger extension 23 against set screw 44 in the absence of any force imposed by the archer against trigger handle 42. As shown in FIG. 3, the axis of coupling 50 lies intermediate shafts 52 and 53. In the quiescent state, the force imposed upon face 28 of holding member 23 will be directed through coupling 50, the line of force being substantially along the axis of coupling 50. Set screw 44 is adjusted to provide that shaft 53 is slightly higher than shaft 20, therefore the force directed along the axis of coupling 50 reinforces the force of spring 21. In order to release bowstring 12, trigger assembly 13 is rotated clockwise by depressing trigger handle 42 until the force transmitted through coupling 50 passes through the center of shaft 20 and commences to oppose the force of spring 21.

Referring now to FIG. 4, the ability of the present invention bowstring draw and trigger release apparatus 10 to smoothly release bowstring 12 can be best seen. Another object of the present invention is to provide for the smooth release of bowstring 12 without the need for a sear or other release mechanism which requires the sliding and frictional engagement of elements. In the orientation of the present invention shown in FIG. 4, the bowstring 12 is released by urging trigger handle 42 against the resilient force imposed by spring 21. As stated, by causing trigger 13 to rotate clockwise about shaft 20, trigger extension 43 wil cause the terminus of the coupling 50 which is connected thereto tò be drawn downwardly. Since holding member 23 is journeled about shaft 46, the downward movement of coupling 50 will cause holding member 23 to be rotated in a clockwise direction in the manner shown in FIG. 4. As soon as the angle between face 28 and the path of the flight of the arrow becomes less than 90°, loop 27 of draw cord 14 will be caused to slip from holding member 23 thereby causing the release of bowstring 12. After the archer releases trigger assembly 13, the resilient urging of spring 21 will cause trigger 13 to rotate counter-clockwise about shaft 20 and return to its initial state. Set screw 44 provides the adjustable stop for trigger extension 43 as can be best seen in FIG. 3. The adjustment provided by set screw 44 will terminate the counterclockwise rotation of trigger 13 and the upward movement of coupling 50. Since holding member 23 is moveable only by rotating about shaft 46, the quiescent state of holding member 23 is as shown in FIG. 3, i.e., vertical. Set screw 44 can be adjusted to properly position holding member 23 in a manner which will insure that bowstring draw cord 14 will remain stationary against face 28 while bowstring 12 is being withdrawn to the cocked position.

Another form of the present invention can be best seen by reference to FIG. 6 wherein the form of the present invention bowstring draw and trigger release shown therein is generally designated by the reference numeral 60. The form of the present invention shown in FIG. 6 comprises a body 51 which is typically cylindrical. body 61 includes spine 62 along the upper portion thereof which defines a pair of flanges similar to that shown in FIG. 2, the cross-sectional view shown in FIG. 6 illustrating only a single flange 63. A bowstring draw cord 64 is secured within flange 63 by a set screw 65 or other suitable securing member. Draw cord 64 is disposed about bowstring 12 in the manner described in connection with FIG. 3. Holding member 65 is journeled about shaft 66 by suitable bearings, face 67 of holding member 65 being adapted to receive draw cord 64 when bowstring 12 is being withdrawn into the cocked position. Triggering cam 68 is disposed within the cavity created by spine 62 and is journeled about shaft 69 by suitable bearings. End 70 of cam 68 is provided with notch 71 on the lower end thereof, notch 71 being adapted to engage triggering handle 72 in a manner which will be described in detail hereinbelow. Coupling 73 is disposed intermediate cam 68 and holding member 65 in the same manner as was described with respect to coupling 50 as shown in FIG. 3, FIG. 4 and FIG. 5. Coupling 73 is journeled intermediate the respective ends of cam 68 and holding member 65, the flange endings of cam 68 and holding member 65 being identical to that shown in FIG. 5 with respect to holding member 23 and trigger extension 43.

Triggering handle 72 extends outwardly through the cavity in body portion 62. Triggering handle 72 is pivotable about shaft 74. The internal end of triggering handle 72 includes a notched projection 75 which is adapted to engage notch 71 of cam 68. The quiescent state of the form of the present invention shown in FIG. 6 is shown in full line. An aperture 80 is disposed through spine 62, set screw 76 being threaded therein to provide for a cam stop limiting the counter-clockwise direction of cam 68. A second aperture 81 is disposd in spine 62, spring 77 and securing set screw 78 being threaded therein to provide for a resilient force adapted to urge the notched end of cam 68 in a counter-clockwise direction. As shown in dotted lines, when triggering handle 72 is urged downwardly, notched projection 75 will rotate upwardly causing notch 71 of cam 68 to cause cam 68 to be urged against spring 77 thereby causing a clockwise rotation fo cam 68. The clockwise rotation of cam 68 will cause coupling 73 to be moved downwardly thereby resulting in clockwise rotation of holding member 65 and the resulting release of bowstring draw cord 64. The manner of preventing premature release is identical to that described with respect to FIGS. 3, 4 and 5. The force of bowstring 12 is directed along the axis of coupling 73 and reinforces the force of spring 77. Until cam 68 rotated to cause the two forces to be in opposition, the bowstring 12 cannot be released.

The form of the present invention shown in FIG. 6 utilizes a handle 82 which is adapted to be held horizontal during the cocking of bowstring 12. Handle 82 is preferably cylindrical in shape and is formed or fabricated of high impact strenth plastic, wood or other suitable material. Finger gripping notches 83 and 84 are provided, notches 83 and 84 being disposed on opposite sides of body portion 62. Notches 83 and 84 are oriented on handle 82 with their transverse centers facing forwardly. When held in the horizontal position, the archer's thumb will be able to move triggering handle 72 in a manner which will cause discharge of draw cord 64 and bowstring 12. Although the form of the present invention shown in FIG. 6 illustrates only a pair of notches 83 and 84, it is clear that handle 82 can be formed to accomodate four finger notches.

The present invention bowstring draw and triggering release apparatus provides simplified and inexpensive means for smoothly releasing the bowstring of an archery bow. Since there is a direct coupling between the triggering and release mechanism of the present invention, the triggering action of the archer is smooth and continuous thereby obviating the deleterious effect which results in the use of a release mechanism having a sear which separates the trigger from the release elements. Since the coupling between the releasing member and the cam or trigger are journeled with suitable bearings, there is no excess wear of any element of the triggering and release members of the present invention. Although it is clear that only a few embodiments of the invention have been illustrated and described, it will be apparent to those having skill in the art that various modifications may be made therein without departing from the scope of the present invention.

I claim:

1. A bowstring draw and release apparatus comprising:

a. a housing comprising a spine and a pair of flanges having inner walls aligned in uniformly parallel spaced relation to one another, said flanges depending from said spine and defining a cavity between the inner walls of said flanges;

b. a bowstring draw cord secured intermediate said flanges of said housing and including a terminal loop, said bowstring draw corn being adapted to be disposed about and draw a bowstring;

c. a holding member pivotally secured between the inner walls of said flanges for movement between first and second positions for holding and releasing the terminal loop of said draw cord respectively whereby the bowstring will be respectively drawn and released;

d. trigger means for releasing the bowstring, said trigger means being pivotally coupled between the inner walls of said flanges in a planar relationship to said holding member and being moveable between first and second positions consistent with the first and second positions of said holding member; and e. a coupling means for aiding oscillatiser of the holding member, said coupling means having first and second ends, the first and second ends of said coupling means being journeled to said trigger means and said holding member, at a position between said flanges, respectively, whereby the movement of said trigger means is transmitted to said holding means by said coupling member to oscillate said holding member between the first and second positions thereof, said coupling means engaging said holding member at an angle of substantially 90° when the holding member is in engagement with the loop when a bow string is in a taut condition, said coupling means being substantially in alignment with the longitudinal axis of the holding member when the loop has been released from a holding member.

2. A bowstring draw and release apparatus as defined in claim 1 wherein said trigger means comprises:

a. a trigger handle;

b. a trigger extension having first and second ends, said first end being integral to said trigger handle, said trigger extension being disposed at an angle to said trigger handle;

c. journel means for coupling said trigger handle and trigger extension between the inner walls of said flanges, said journel means being coupled to said trigger handle and trigger extension at the intersection thereof;

d. fixed means coupled to said spine intermediate said inner walls and extending into said cavity for contacting said trigger extension at the first position of movement thereof; and e. resilient means coupled to said spine and extending into said cavity for contacting said trigger handle and urging said trigger handle to return from the second position to the first position of movement thereof.

3. A bowstring draw and release apparatus as defined in claim 2 wherein the angle between said trigger handle and said trigger extension is 90°.

4. A bowstring draw and release apparatus as defined in claim 2 wherein said resilient means comprises a helical spring adapted to urge said trigger handle and holding member from the second position of movement to the first position of movement thereof.

5. A bowstring draw and release apparatus as defined in claim 2 wherein said trigger extension is a planar member having its longitudinal axis extending between the first and second ends thereof, the second end of said trigger extension comprising first and second parallel flanges, said holding member having a first end extending beyond said housing and a second end lying intermediate said inner walls, the second end of said holding member comprising first and second parallel flanges, the first end of said coupling member being journeled intermediate the first and second flanges of said trigger extension, the secong end of said coupling member being journeled intermediate the first and second flanges of said holding member.

6. A bowstring draw and release apparatus as defined in claim 5 wherein the first position of said holding member defines the position where a bowstring is drawn, said fixed means contacting said trigger extension, said coupling member having an axis extends intermediate the journeled couplings to said holding member and said trigger extension, a projection of said axis being directed on the opposite side of said journel means from said trigger handle whereby a force imposed on said holding member by the bowstring cannot cause said holding member to move from the first to the second position of movement thereof.

7. A bowstring draw and release apparatus as defined in claim 6 wherein said holding member is caused to move from the first to the second position thereof by moving said trigger handle against the force of said resilient means until the projection of the axis of said coupling member is on the same side of the journel means as said trigger handle.

* * * * *